United States Patent [19]

Anderson

[11] 4,165,910

[45] Aug. 28, 1979

[54] ELECTRICAL CONNECTOR

[75] Inventor: Norman R. Anderson, Cicero, Ill.

[73] Assignee: Bunker Ramo Corporation, Oak Brook, Ill.

[21] Appl. No.: 844,554

[22] Filed: Oct. 25, 1977

[51] Int. Cl.[2] ..... H01R 13/54

[52] U.S. Cl. ..... 339/89 M; 339/90 R; 339/DIG. 2

[58] Field of Search ..... 339/89 M, 90 M, DIG. 2

[56] References Cited

U.S. PATENT DOCUMENTS

| | | | |
|---|---|---|---|
| 3,611,260 | 10/1971 | Colardeau et al. | 339/89 R |
| 3,892,458 | 7/1975 | Clark | 339/DIG. 2 X |
| 3,971,614 | 7/1976 | Paoli et al. | 339/DIG. 2 X |
| 4,109,990 | 8/1978 | Waldron et al. | 339/89 M |

*Primary Examiner*—Roy Lake
*Assistant Examiner*—E. F. Desmond
*Attorney, Agent, or Firm*—William Lohff; F. M. Arbuckle

[57] ABSTRACT

An electrical connector is disclosed comprising complementary receptacle and plug connector members, each member having a hollow shell containing an insulating insert which houses electrical contacts. A rotatable coupling ring is carried by the plug and is engageable with the receptacle for mating the connector members and holding the contacts in electrical engagement. A resilient means is interposed between the coupling ring and the plug and has a predetermined range of axial deflection relative to the plug. The receptacle is provided with a plurality of bayonet pins and the coupling ring has a corresponding plurality of pin-receiving tracks to provide a bayonet type releasable connection between the coupling ring and the receptacle. The coupling ring has limited axial movement relative to the plug so that upon mating of the connector members, the coupling ring moves axially along the plug toward the receptacle compressing the resilient means therebetween. A detent means is disposed between the coupling ring and the plug and has a predetermined range of radial movement. The coupling ring has at lest one interior axial slot which extends forwardly from its rearward end, and the detent means is releasably engageable with the slot when the connector is fully mated to substantially preclude inadvertent rotational movement of the coupling ring.

17 Claims, 7 Drawing Figures

10
21
22
23
33
40
46
4
4
20
25
27
3
3
31
32
34
35
36
38
30
50
60
65
66
67
68
70

ELECTRICAL CONNECTOR

BACKGROUND OF THE INVENTION

The present invention is directed generally to electrical connectors and, more particularly, to connectors employing a bayonet type coupling mechanism and having means to prevent inadvertent uncoupling of the connectors.

One form of conventional electrical connector used today includes a plug and receptacle each of which contains an insulative material carrying a plurality of engageable contacts therein, whereby when the plug and receptacle are fully mated the contacts are engaged to complete an electrical circuit therebetween. A bayonet type connector coupling mechanism is frequently employed to positively retain the plug and receptacle of the connector in the fully mated position.

The bayonet coupling mechanism generally includes bayonet pins projecting radially outwardly from the shell of one of the sections of the connector, frequently the receptacle, which is fixedly connected to a wall, panel or other stationary support. A coupling ring is carried by the other section of the connector, i.e., the plug, and has a corresponding plurality of bayonet tracks therein. The coupling ring has entrance portions at the forward or mating end thereof from which the tracks extend rearwardly, frequently terminating in detent recesses that extend back toward the forward end of the coupling ring. The bayonet pins enters these tracks as the connector is mated and move to the rearward ends of the tracks as the coupling ring is rotated. The coupling mechanism also includes a spring mounted between the coupling ring and the plug which acts to hold the bayonet pins against the detent recesses at the ends of the tracks to retain the coupling ring, plug and receptacle in the fully mated orientation. In addition to providing the positive locking action, the interaction of the bayonet pins and detent recesses provide a positive snapping sound whereby the individual assembling the connector will have both a tactile and an audible confirmation of the electrical connection.

While such an arrangement is generally acceptable, it has been found that under extreme vibration, or after repeated connections and disconnections, the failure rate of the coupling mechanism tends to rise. The vibratory forces cause the pins to disengage from the detent recesses, whereupon the parts might separate due to the spring force, or, alternatively, frequent coupling causes the pins to wear away the detent recesses, particularly under the coupling forces applied by the biasing spring. As the detent recesses wear away, vibration tends to become a more serious problem and tension loads may alone result in the unmating of the connector members.

SUMMARY OF THE INVENTION

Accordingly, the present invention is directed to an improved electrical connector which overcomes the particular difficulties and disadvantages associated with prior art connectors outlined above and which is particularly useful in conjunction with bayonet type coupling mechanisms.

More particularly, an important feature of the present invention is the provision of a secure bayonet connection in conjunction with an electrical connector which does not depend upon the interaction of the bayonet pins and tracks to prevent the inadvertent rotation and possible accidental disassembly of the connector members.

Another important feature of the present invention is the provision of a bayonet type electrical connector which employs a radially biased detent means operable in conjunction with the coupling ring and independently of the bayonet pins and tracks.

It is a further object of the present invention to provide, in a bayonet type electrical connector of the type described, positive detent means which applies a radially directed force on the coupling ring and which positively engages the ring in a fashion which minimizes the possibility that the ring will rotate when exposed to extreme vibration. The radially acting detent means also provides an audible snapping action, assuring the assembler of the connector of the positive locking engagement of the respective plug and receptacle.

The electrical connector of the present invention generally comprises complimentary plug and receptacle connector members each having a hollow shell containing an insulating insert adapted to carry at least one electrical contact therein for axial connection in electrical engagement with a corresponding contact in the opposing insulating insert. One connector member has a plurality of bayonet pins extending radially therefrom and the other connector member includes a rotatable coupling ring having bayonet tracks engageable with the bayonet pins of the one connector member to hold the connector members in fully mated assembly. A resilient means having a predetermined range of axial deflection is interposed between the coupling ring and its associated connector member, and the coupling ring is capable of limited axial movement relative to its associated connector member so that upon connection of the coupling ring with the one connector member the coupling ring moves axially along its associated connector member toward the one connector member, thereby compressing the resilient means. Detent means having a predetermined range of radial movement are carried by the other connector member between its shell and the coupling ring, the detent means being equidistantly arranged about the circumference of the plug. The coupling ring has a corresponding plurality of axial slots formed on the inner wall thereof and extending forwardly from the coupling ring's rearward end. The detent means are releasably engageable with the slots to substantially preclude rotational movement of the coupling ring relative to its associated connector member when the detent means engage the slots, except upon the application of deliberate and substantial force to the coupling ring applied during connection or disconnection of the connector, thereby precluding accidental unmating of the connector members by vibration while minimizing wear in the bayonet connection.

BRIEF DESCRIPTION OF THE DRAWINGS

The features of the present invention which are believed to be novel are set forth with particularity in the appended claims. The invention, itself, however, together with further objects and advantages thereof, may best be understood by reference to the following description, taken in connection with the accompanying drawings in which:

DESCRIPTION OF THE PREFERRED EMBODIMENT

Figures 1, 2, 5, 6, 7:
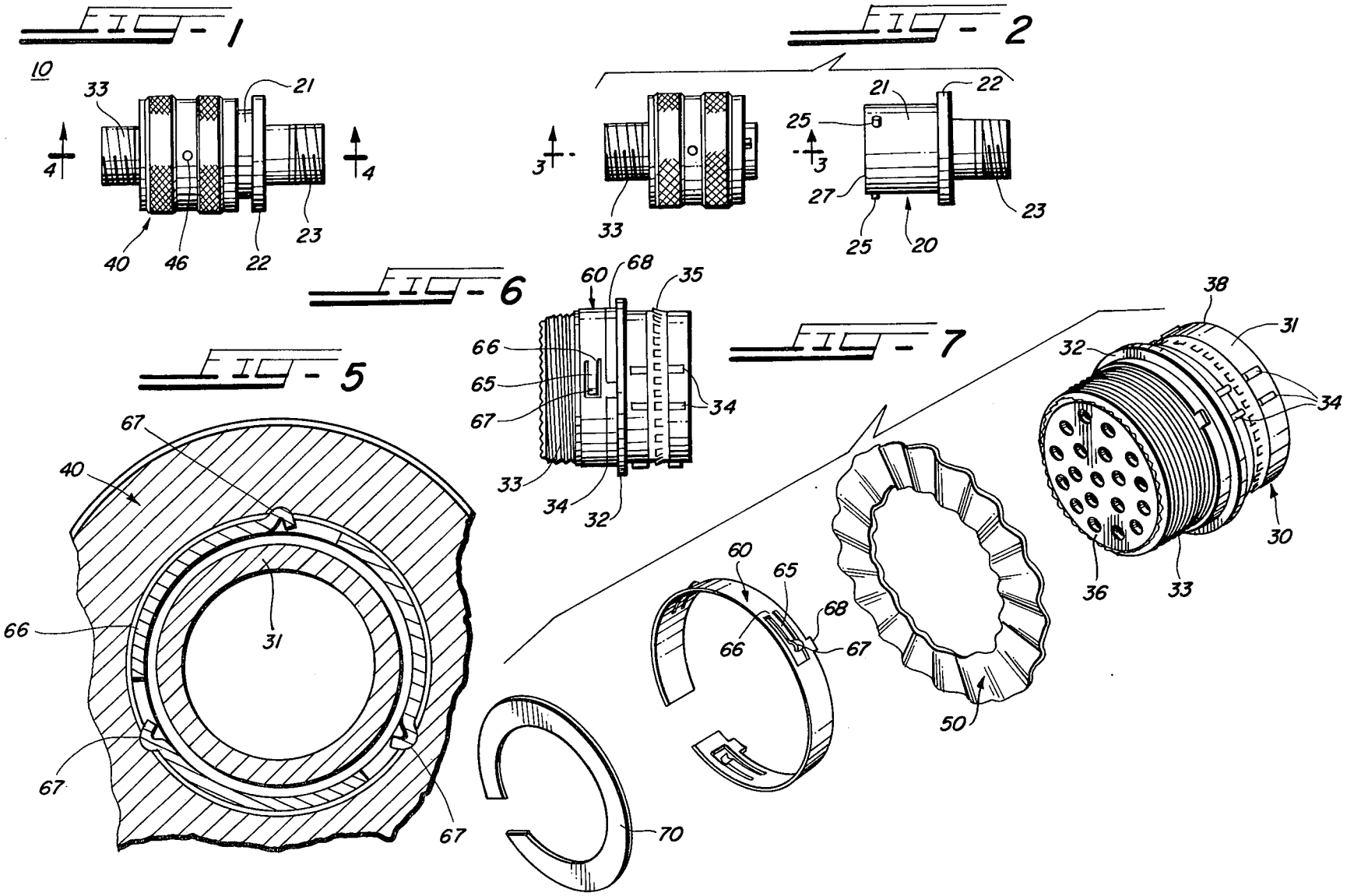
FIG. 1 is a side elevational view of a bayonet connector in fully mated assembly and constructed in accordance with and embodying the features of the present invention.
FIG. 2 is an exploded side elevational view of the connector of FIG. 1, illustrating the relative position and certain details of the various parts prior to mating.
FIG. 5 is an enlarged cross-sectional view of the connector plug and coupling ring, taken along line 5—5 in FIG. 3.
FIG. 6 is a slightly enlarged side elevational view of the plug member of the electrical connector of the present invention.
FIG. 7 is an enlarged and exploded perspective view illustrating the relationship of certain of the component parts of the connector as constructed in accordance with and embodying features of the present invention.

Illustrated in the drawings is a multiple pin and socket electrical connector designated generally by the numeral 10 and which includes a receptacle, designated generally as 20, and a plug, designated generally by the numeral 30. The mechanical connection of the receptacle 20 and plug 30 is accomplished by means of a bayonet type coupling mechanism including an overlying coupling ring, designated generally by the numeral 40, carried by the plug 30.

Figure 4:
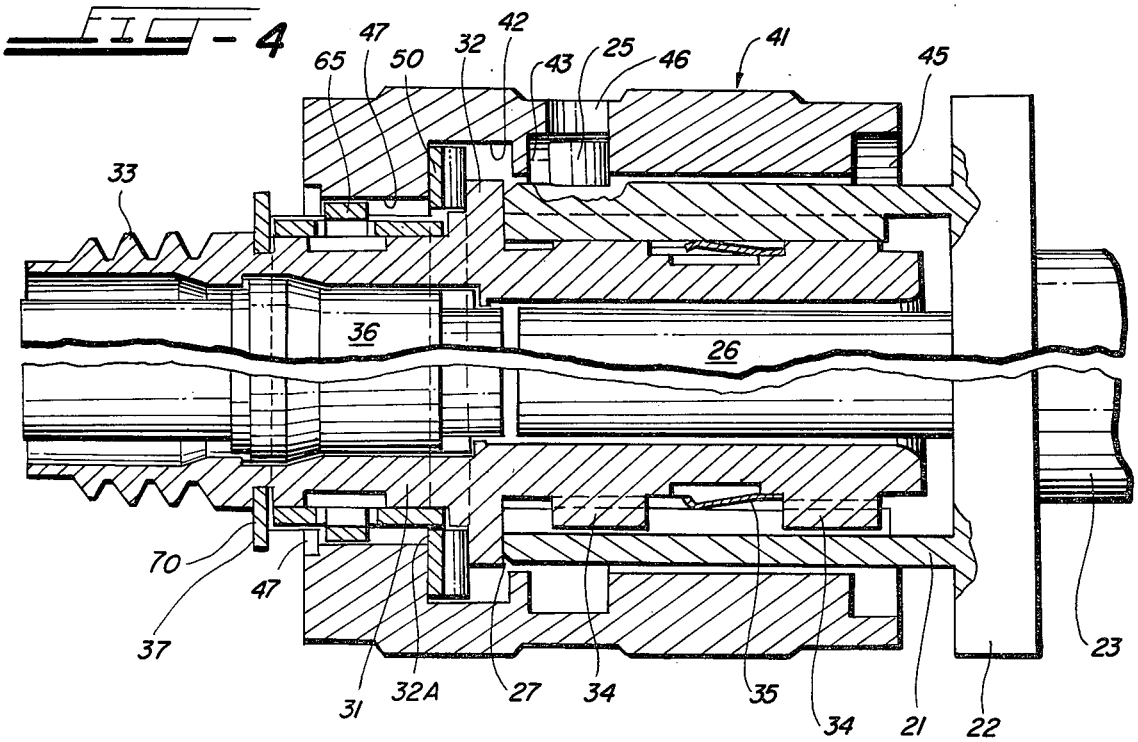
FIG. 4 is an enlarged cross-sectional view of the connector taken along line 4—4 in FIG. 1.

The receptacle 20 is conventional and well known in the art and includes a receptacle shell 21 which is a generally tubular metal member of circular cross-section and which may include a mounting flange 22 whereby the receptacle may be fixedly secured to an associated stationary support member by conventional fasteners. The receptacle 20 also includes a threaded end 23, as is conventional and well known in the art, and a plurality of radially extending bayonet pin 25 equidstantly arranged about the shell 21 for interengagement with the coupling ring 40 as hereinafter described. The receptacle 20 further includes an insulating insert assembly 26 which serves to retain and hold a plurality of electrical contacts (not shown) in a customary and well-known fashion. The details of the electrical contacts and their installation in the receptacle 20 and in the plug 30 form no part of the present invention and therefore are illustrated only generally and in schematic fashion in the drawings. As best illustrated in FIG. 4, a plurality of axially extending keyways 24 are spaced about the interior wall of the shell 21 at predetermined positions, facilitating proper alignment of the plug 30 relative to the receptacle 20.

The plug member 30 also consists of a generally circular tubular metal member defining a shell 31 constructed for interlocking engagement with the receptacle 20. An insulative insert 36 is disposed within the shell and carries at least one, and generally a plurality of electrical contacts such as 36A thereon in a conventional manner. The shell 31 is provided approximately midway thereof with an outwardly extending annular engaging flange 32 which, when the plug shell 31 and receptacle shell 21 are in the properly engaged position, provides an abutment shoulder which engages the terminal end 27 of the receptacle shell 21, as best seen in FIG. 4. Alternatively, the opposing mating faces of the plug and receptacle inserts may form the abutting interface of the connector member, in which case the terminal end 27 of the receptacle 20 may be slightly spaced from flange 32.

To assure proper alignment of the plug shell 31 relative to the receptacle shell 21, thereby assuring proper mating engagement of the electrical contacts, the shell 31 is provided with a plurality of outwardly extending, aligned and axially spaced keys 34. The keys 34 are intended to be disposed in the keyways 24 as the plug shell 31 is inserted into the receptacle shell 21. Not only does the interengagement of the keys 34 with the keyways 24 provide alignment of the plug 30 and receptacle 20, it also precludes rotational movement of those parts relative to one another when properly assembled.

The plug shell 31 also includes an annular spring receiving groove 37 formed around its periphery and disposed to one side of the engaging flange 32. In addition thereto, it should be noted that the engaging flange is provided with an offset shoulder portion 32A (FIG. 3), which shoulder includes a plurality of generally rectangular notches 38 therein spaced equidistantly thereabout. Finally, the shell 31 is provided with a second annular groove therein for receiving a snap ring 70, as later described.

The mechanism for securing the plug 30 to the receptacle 20 in the mated position includes the coupling ring 40 that is carried by and circumscribes the plug shell 31. The coupling ring 40 also is composed of a generally circular tubular metal shell 41, which shell is provided with a plurality of bayonet tracks 45 extending rearwardly from the forward end thereof. Each track 45 includes a slightly enlarged entry opening at the forward end of the ring and a curved rearward portion along which the bayonet pin travels during the coupling operation. In accordance with the present invention, the detent recesses normally provided at the ends of the tracks are not necessary and may be eliminated.

Figure 3:
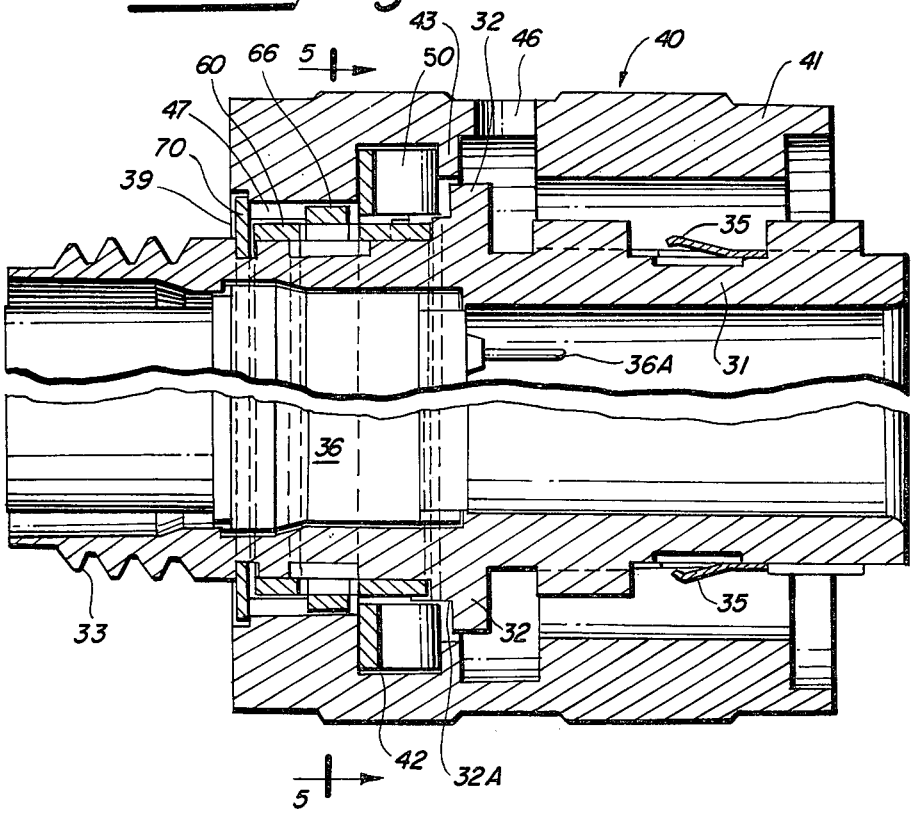
FIG. 3 is an enlarged cross-sectional view taken along line 3—3 of FIG. 2.

The coupling ring 40 further includes a plurality of circumferentially spaced apertures 46, through which the ends of the bayonet pins 25 are visible when the connector members are fully mated. To facilitate visual inspection, the ends of the pins 25 may be painted to contrast with the exterior finish of the coupling ring adjacent the apertures 46. An annular recess 42 is disposed on the interior of the coupling ring 40 and is defined in part by a first depending flange 43. The extent of the flange 43 is such that as the coupling ring 40 is moved axially, the flange 43 is free to move over and forward of the engaging flange 32 of shell 31, as best seen in FIGS. 3 and 4. Interposed between the engaging flange 32 of shell 31 and in the groove 42 of coupling ring 41 is a resilient means 50, generally in the form of a wave spring (FIG. 7).

When the electrical connector is to be mated, the forward portion of the shell 31 enters the forward portion of the receptacle shell 21 with the keys 34 disposed within the keyways 24 of the receptacle, assuring the proper rotational orientation of the plug and receptacle. The coupling ring 40 is then rotated until the forwardmost ends of the tracks 45 are aligned with the bayonet pins 25. As the coupling ring continues its rotation, movement of the tracks 45 about the pins 25 causes the ring 40 to move axially forward relative to the shell 31 and, at the same time, causes shell 31 to move axially relative to the receptacle 20 until such time as the opposing forward cases of the inserts 26 and 36 abut or the terminal end 27 of the receptacle shell 21 abuts the engaging flange 32 of the plug shell 31. The parts are dimensioned such that, upon engagement, the bayonet pins 25 will have reached the terminal ends of the bayonet tracks 45, with the pins 25 being visible through the apertures 46. During this operation, the wave spring 50 is initially under compression and as the coupling ring 40 is rotated the spring 50 is further compressed, thereby providing a coupling force which assures positive abutment of the receptacle and plug members, 20 and 30.

In accordance with the present invention, detent means applying a radially directed force on the coupling ring 40 are provided to assure that the connector remains in fully mated assembly when the bayonet pins 25 have reached the terminal points in the tracks 45. The coupling ring shell 41 has a plurality of axial slots 47 extending from the rearward terminal edge to the annular recess 42 in which the wave spring 50 is seated. The slots 47 cooperate with the detent means carried by the plug shell 31 to releasably engage the detent means when the bayonet pins 25 are in their terminal positions. The detents are most preferably formed on a spring ring 60 disposed between the plug shell 31 and the coupling ring shell 41. The ring 60 has a plurality of cantilevered leaf springs 65 punched therefrom, the base end 66 of each spring 65 remaining integral with the ring 60, while the distal end 67 is formed in a semicircular configuration to conform to the configuration of the axial slots 47. It will be appreciated, of course, that the base end 66 of each spring 65 is substantially precluded against radial movement while the deformed end 67 is capable of movement into the slots 47 in the coupling ring 40. As the coupling ring 40 is rotated in the coupling direction relative to the plug 30, the ring 40 will cause the springs 65 to be depressed such that the ends 67 thereof will move downwardly into the annular spring groove 37 provided in shell 31. The spring ring 60 also has a plurality of outwardly extending generally rectangular lugs 68 disposed in the notches 38 formed in shoulder 32A of shell 31. The interengagement of lugs 68 and notches 38 prevent rotation of the spring ring 60 as the coupling ring 40 is rotated about plug 30. The ring 60, when seated on the shell 31, is substantially equal in height to shoulder 32A on flange 32.

The slots 47 in the coupling ring 40 are spaced approximately 120° apart, generally semicircular in cross section will simultaneously engage the distal ends 67 of the leaf springs 65 which are also spaced about 120° apart.

The snap ring 70 serves to hold the spring ring 60 in fixed position and precludes rearward axial movement relative to the shell 31 of both the ring 60 and the coupling ring 40.

In the unmated condition, if the springs 65 are located within the slots 47, the springs 65 pre-position the coupling ring 40 such that the keyways 24 are aligned with the keys 34 and the entry opening of each track 45 is aligned with a respective bayonet pin. If springs 65 and slots 47 are not engaged, simple clockwise rotation will snap the coupling ring into the proper orientation to permit further engagement of the collar 40 relative to the bayonet pins. Further clockwise rotation will engage the tracks 45 on the pins 25 and will ultimately force the ends of the springs 65 out of the slots 47.

The spring ring 60 is designed such that the springs 65 push away from the fixed ends 66 of the cantilevered springs when the coupling ring 40 is rotated for mating and therefore the force required in the clockwise direction for mating purposes is relatively small. Rotation over a 120° arc brings about full engagement of the bayonet pins 25 in the tracks with the pins being visible through the apertures 46 and at the same time the distal ends 67 of each spring 65 will snap into engagement with the respective slot 47, thus providing an audible signal to the individual making the connection.

In uncoupling the connector members, the torque required to disengage the springs 65 from the slots 47 will be greater than when coupling the connector because the slot 47 must move slightly toward the base 66 of the cantilevered leaf spring 65. The higher torque requirement for unmating helps to assure that high vibration will not cause disengagement and accidental rotation of the coupling ring 40 relative to the receptacle 20. Moreover, the axial forces transmitted by the wave spring 50 will not be transmitted to the detent mechanism as occurs in the some of the prior art connectors. And, accordingly, wear of the detent mechanism due to application of coupling forces is avoided.

It will be apparent from the foregoing that there has been provided a novel and improved bayonet connector in which a radially operating detent means provided by a cantilevered leaf spring assures positive mechanical locking engagement between the coupling ring and the associated receptacle, thereby minimizing the possibility of disconnection due to vibration. In addition, the illustrated embodiment employs a multi-detent mechanism which applies equal forces about the circumference of the coupling ring to assure proper alignment and prevent canting of the coupling ring on the plug member. The detent mechanism is also integrally formed as a unitary component, i.e., the spring ring 60, such that assembly of the plug member, coupling ring and detent mechanism is facilitated, and the possibility of the individual spring 65 being dislodged from their seating is virtually eliminated. Of course, since the spring ring may be fabricated in a simple stamping and forming operation, its cost of manufacture is relatively low. The design of the detent mechanism also allows its positioning remote from the coupling mechanism, that is the track and bayonet pin structures. Accordingly, existing bayonet connectors may be easily modified to accept the new detent mechanism without affecting the established satisfactory coupling operation of such connectors. Finally, the detent mechanism of the present invention requires virtually no additional axial space other than that already available within the connector, thereby enhancing its utility of the invention in those connector applications wherein the overall length of the connector must be minimized.

The discriptive terms "forward" and "rearward" as used herein are intended solely to facilitate an understanding of the invention and refer to the "mating" and "unmating" directions, respectively, with respect to each connector member. Thus, the forward end of the receptical 20 is that portion which interfaces with the plug 30, while its rearward end would conventionally receive the electrical conductors to which the plug 30 is to be connected.

While there has been described what is at present considered to be the preferred embodiment of the invention, it will be understood that various modifications may be made therein, and it is intended that the appended claims cover all such modifications as fall within the true spirit and scope of the invention.

I claim:

1. An electrical connector comprising complimentary receptacle and plug connector members, each member comprising a hollow shell containing an insulating insert, each of said inserts supporting at least one electrical contact therein with the contacts being adapted for axial connection in electrical engagement with a corresponding contact of the opposing insert;

a rotatable coupling ring carried by one of said shells and engageable with said other shell for mating said connector members and holding the contacts therein in engagement;

resilient means interposed between said coupling ring and said one shell and having a predetermined range of axial deflection relative to said one shell;

said other shell having a plurality of radially extending bayonet pins and said coupling ring having a corresponding plurality of pin receiving tracks to thereby provide a bayonet type releasable connection between said coupling ring and said other shell, said coupling ring having limited axial movement relative to said one shell so that upon connection of said coupling ring with said other shell said coupling ring moves axially along said one shell toward said other shell compressing said resilient means therebetween; and detent means disposed between said coupling ring and said one shell and having a predetermined range of radial movement, said coupling ring having at least one axial slot formed on the inner wall thereof and extending forwardly from the rearward end of the coupling ring, said detent means being readily removable through said rearward end for replacement purposes without dismantling said connector when fully mated, and said detent means being releasably engageable with said slot when said connector is fully mated to preclude inadvertent uncoupling of said connector.

2. The electrical connector set forth in claim 1, wherein said detent means includes means cooperable with said one shell for precluding rotation thereof relative to said one shell.

3. The electrical connector set forth in claim 1, including a plurality of said detent means equally spaced circumferentially about said one shell and a corresponding plurality of said axial slots in said coupling ring.

4. The electrical connector set forth in claim 1, wherein said detent means comprises a cantilevered leaf spring having a base substantially fixed against radial movement relative to said one shell and a distal end for engaging said slot, whereby the torque required to unseat said spring from said slot will be greater in the unmating direction of rotation of said coupling ring than in the mating direction of rotation thereof.

5. The electrical connector set forth in claim 4, wherein said slot is generally semicircular in cross section and the slot engaging end of said leaf spring is formed complementary to said slot, to thereby assure relative rotational movement of said coupling ring in both directions relative to said spring.

6. The electrical connector set forth in claim 5, and further including a plurality of said leaf springs equidistantly positioned about the circumference of said one shell, said coupling ring having a corresponding plurality of slots therein to thereby evenly distribute the detent forces on said coupling ring.

7. The electrical connector set forth in claim 6, wherein said plurality of springs are integrally formed on a unitary detent ring, said detent ring being disposed on said one shell.

8. The electrical connector set forth in claim 7, wherein said detent ring includes a plurality of axially extending lugs thereon, and said one shell has a plurality of complementary shaped notches formed therein whereby said lugs cooperate with said notches to prevent rotational movement of said detent ring relative to said shell.

9. An electrical connector comprising complementary receptacle and plug connector members, each member comprising a hollow shell containing an insulating insert, each of said inserts supporting at least one electrical contact with the contacts of each member being adapted for axial connection in electrical engagement with a corresponding contact carried in the other member;

a rotatable coupling ring carried by said plug and engageable with said receptacle for mating said connector members and holding the contacts therein in engagement;

resilient means interposed between said coupling ring and said plug and having a predetermined range of axial deflection relative to said plug;

said receptacle having a plurality of bayonet pins and said coupling ring having a corresponding plurality of pin-receiving tracks to provide a bayonet type releasable connection between said coupling ring and said receptacle, said coupling ring having limited axial movement relative to said plug so that upon connection of said coupling ring with said receptacle said coupling ring moves axially along said plug toward said receptacle thereby compressing said resilient means; and a plurality of detent means disposed between said coupling ring and said plug and having a predetermined range of radial movement, said detent means being equidistantly arranged about the circumference of said plug and said coupling ring having a corresponding plurality of interior axial slots extending forwardly from the rearward end of said coupling ring, said detent means being readily removable through said rearward end for replacement purposes without dismantling said connector when fully mated, and said detent means being releasably engageable with corresponding ones of said slots when said connector is fully mated to thereby substantially preclude rotational movement of said coupling ring relative to said plug except upon the application of deliberate external force to said coupling ring applied during disconnection of said members.

10. The electrical connector set forth in claim 9, wherein said detent means includes means cooperable with said plug for precluding rotation of said detent means relative to said plug.

11. The electrical connector set forth in claim 9, wherein each of said detent means comprises a leaf spring having a base substantially fixed against radial movement relative to said plug, whereby the torque required to unseat said springs from said slots will be greater in the unmating direction of rotation fo said coupling ring than in the mating direction of rotation thereof.

12. The electrical connector set forth in claim 11, wherein each said slot is generally semicircular in cross section and the slot engaging end of each said leaf spring is formed complementary to said slot, to thereby assure relative rotational movement of said coupling ring in both directions relative to said springs.

13. The electrical connector set forth in claim 11 wherein said plurality of springs are integrally formed on a single detent ring.

14. The electrical connector set forth in claim 13, wherein said detent ring includes a plurality of axially extending lugs and said plug has a plurality of complementary shaped notches, said lugs cooperating with said notches to prevent rotational movement of said detent ring relative to said shell during rotation of said coupling ring.

15. An electrical connector comprising complementary receptacle and plug connector members, each member comprising a hollow shell containing an insulating insert, each of said inserts supporting at least one electrical contact therein with the contacts being adapted for axial connection in electrical engagement with a corresponding contact of the opposing insert;

a rotatable coupling ring carried by one of said shells and engageable with said other shell for mating said connector members and holding the contacts therein in engagement; and detent means disposed between said coupling ring and said one shell and having a predetermined range or radial movement, said coupling ring having at least one axial slot formed in the inner wall thereof and extending forwardly from the rearward end of the coupling ring, said detent means being readily removable through said rearward end for replacement purposes without dismantling said connector when fully mated, and said detent means being releasably engageable with said slot when said connector is fully mated to preclude unintentional uncoupling of said connector.

16. The electrical connector set forth in claim 15, including means releasably mounted on said one shell and engageable with said rearward end of said coupling ring for maintaining said detent means in position and preventing unintentional removal thereof.

17. The electrical connector set forth in claim 16, wherein said last named means comprises a snap ring.

* * * * *